US005460520A

United States Patent [19]

Lin

[11] Patent Number: 5,460,520

[45] Date of Patent: Oct. 24, 1995

[54] TRIGGER-CONTROLLED PALM-TOP GAS TORCH

[76] Inventor: H. T. Arlo Lin, No. 5, Lane 25, Tatung Rd., Wu Fong Hsiang, Taichung Hsien, Taiwan

[21] Appl. No.: 314,186

[22] Filed: Sep. 28, 1994

[51] Int. Cl.[6] ..... F23D 14/46; F23D 14/00

[52] U.S. Cl. ..... 431/255; 431/266; 431/345; 431/344; 126/406

[58] Field of Search ..... 431/344, 345, 431/254, 255, 142, 266; 126/406

[56] References Cited

U.S. PATENT DOCUMENTS

| | | | |
|---|---|---|---|
| 2,727,376 | 12/1955 | Felt . | |
| 4,292,021 | 9/1981 | Miyagawa | 431/255 |
| 4,502,465 | 3/1985 | Yoshinaga et al. | 431/255 X |
| 4,516,933 | 5/1985 | Buzzi | 431/355 |
| 5,082,440 | 1/1992 | Yamamoto | 431/255 |

FOREIGN PATENT DOCUMENTS

| | | | |
|---|---|---|---|
| 0347384 | 12/1989 | European Pat. Off. | 431/255 |
| 0800498 | 2/1981 | U.S.S.R. | 431/255 |

*Primary Examiner*—Carl D. Price
*Attorney, Agent, or Firm*—Pro-Techtor International

[57] ABSTRACT

A gas torch including a containing, which holds a disposable gas lighter, a casing detachably connected to the container at a top thereof to hold an electric ignition device, the casing having a horizontal partition wall to hold a gas flow guide and a flame nozzle, and a trigger turned about a pivot inside the casing and controlled to depress the gas lever of the disposable gas lighter and the control lever of the electronic ignition device, causing a flame produced at the flame nozzle.

2 Claims, 6 Drawing Sheets

TRIGGER-CONTROLLED PALM-TOP GAS TORCH

BACKGROUND OF THE INVENTION

The present invention relates to gas torches, and relates more particularly to a trigger-controlled, palm-top gas torch.

Various gas torches are well-known and intensively used for welding things by burning fuel gas from a commercially available disposable gas lighter. FIG. 1 shows a typical handy gas torch of this type, which comprises a casing 10, a container 11, which holds a disposable gas lighter 12, a flame nozzle 13 at the front end of the casing 10, an electronic ignition device 14 inside the casing 10, and a push-button 15. When the push-button 15 is depressed, a pressure rod 17 is driven to press the gas lever 18 of the disposable gas lighter 12, causing the gas flow control valve 19 lifted to let fuel gas be guided to the flame nozzle 13 for burning. At the same time, the electronic ignition device 14 is triggered to produce sparks through an ignition terminal 16, and therefore a flame is produced at the flame nozzle 13. This structure of handy gas torch is functional. However, when in operation, the container 11 must be held in the palm, and the thumb must be pressed on the push-button 15. Because this arrangement is not orthopedically engineered, the user's hand feels uncomfortable during the operation.

SUMMARY OF THE INVENTION

The present invention has been accomplished to provide an orthopedically engineered, trigger-controlled, palm-top gas torch which is comfortable and convenient in use.

According to one aspect of the present invention, the gas torch comprises a containing, which holds a disposable gas lighter, a casing detachably connected to the container at a top thereof to hold an electric ignition device, the casing having a horizontal partition wall to hold a gas flow guide and a flame nozzle, and a trigger turned about a pivot inside the casing and controlled to depress the gas lever of the disposable gas lighter and the control lever of the electronic ignition device, causing a flame produced at the flame nozzle. According to another aspect of the present invention, a locking device is mounted within a hole on the trigger and switched between a locking position to lock the trigger from being turned about the pivot and an unlocking position to let the trigger be turned about the pivot.

DETAILED DESCRIPTION OF THE PREFERRED EMBODIMENT

Figure 1:
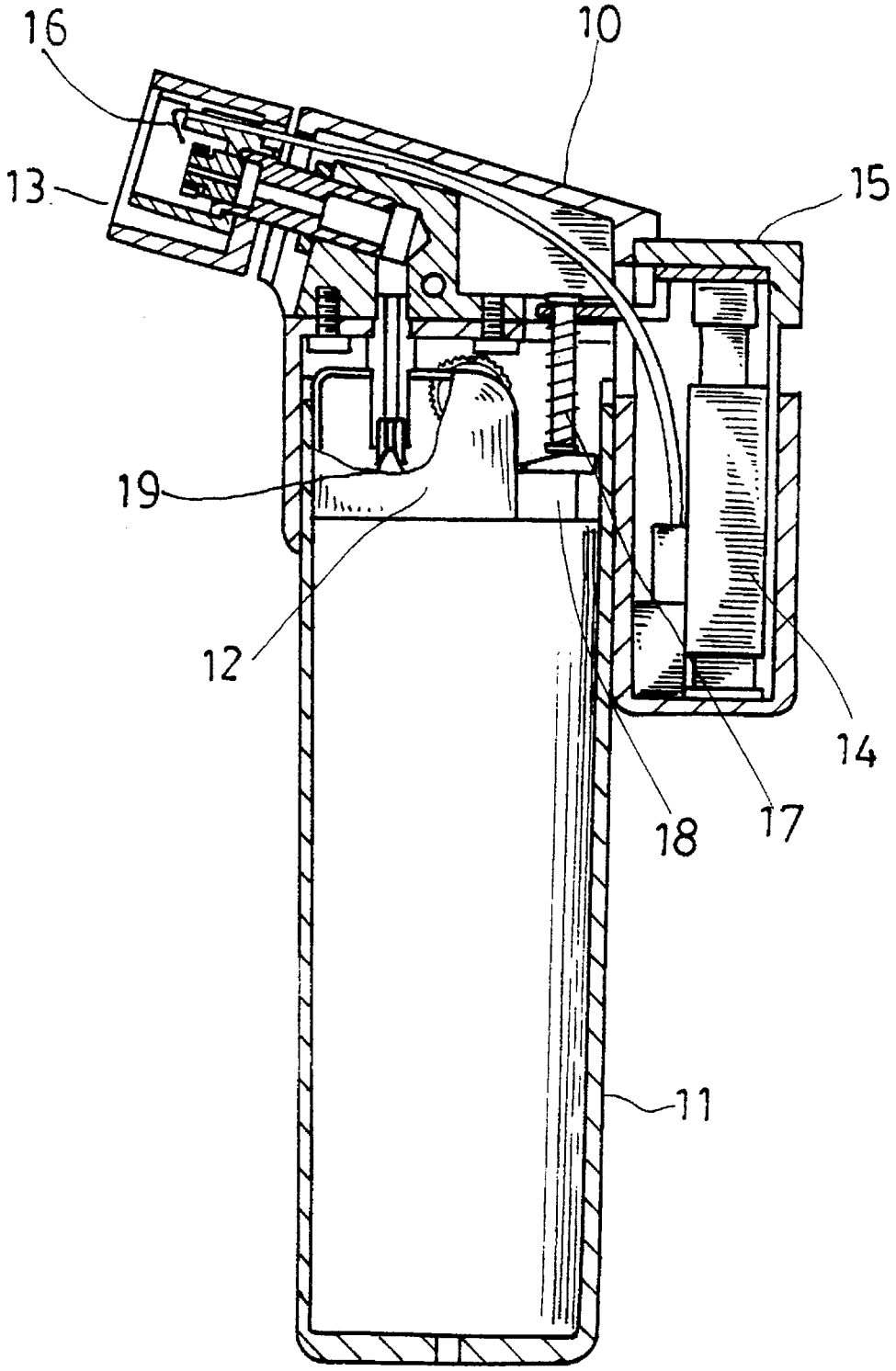
FIG. 1 PRIOR ART
FIG. 1 is a longitudinal view in section of a handy gas torch according to the prior art.
Figure 2:
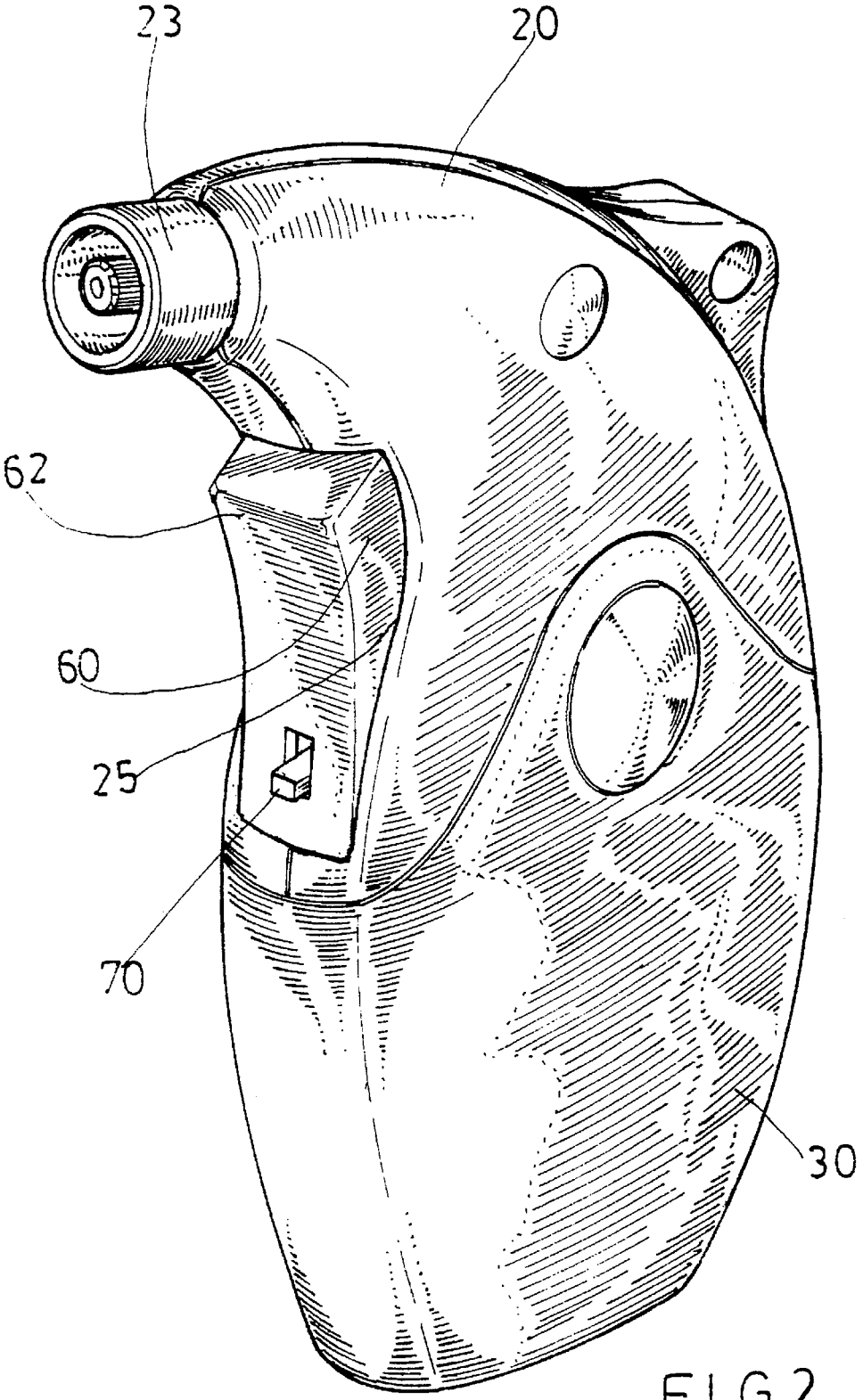
FIG. 2 is an elevational view of a trigger-controlled palm-top gas torch according to the present invention.
Figure 3:
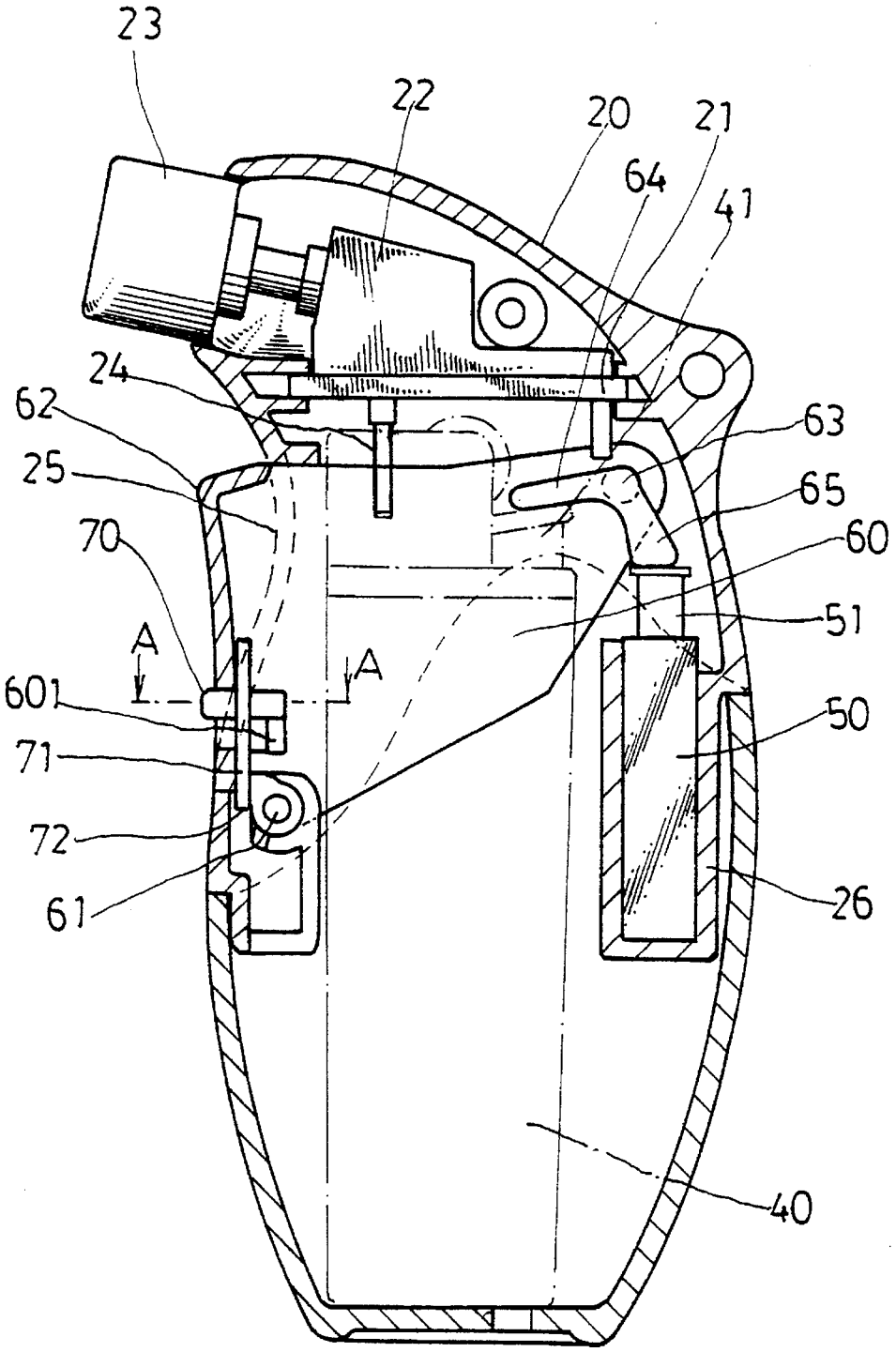
FIG. 3 is a longitudinal view in section of the trigger-controlled palm-top gas torch shown in FIG. 2.

Referring to FIGS. 2 and 3, a trigger-controlled palm-top gas torch in accordance with the present invention is generally comprised of a casing 20 and a container 30 detachably connected to the casing 20. The container 30 defines a suitable holding space and has locating means (not shown) for holding a disposable gas lighter 40 inside the holding space. A partition wall 21 is made inside the casing 20 to hold a gas flow guide 22. A flame nozzle 23 is connected to the gas flow guide 22 and disposed outside the casing 20. The gas flow guide 22 has one end connected to the gas flow control valve (not shown) of the disposable gas lighter 40 by a gas tube 24, and an opposite end connected to the flame nozzle 23. The casing 20 has an elongated front slot 25 spaced below the gas nozzle 23, and a back chamber 26 on the inside remote from the front slot 25. An electronic ignition device 50 is mounted within the back chamber 26. A trigger 60 is disposed inside the casing 20 below the partition wall 21 and turned about a pivot 61, having a smoothly curved front projection 62 extended out of the front slot 25 for pressing by fingers and a rear actuating bar 63. The rear actuating bar 63 of the trigger 60 terminates in two rod sections, namely, the first rod section 64 stopped above the gas lever 41 of the disposable gas lighter 40 and a second rod section 65 stopped above the control lever 51 of the electronic ignition device 50. The arrangement of the trigger 60 must not be an obstacle to the loading of the disposable gas lighter 40.

Figure 4:
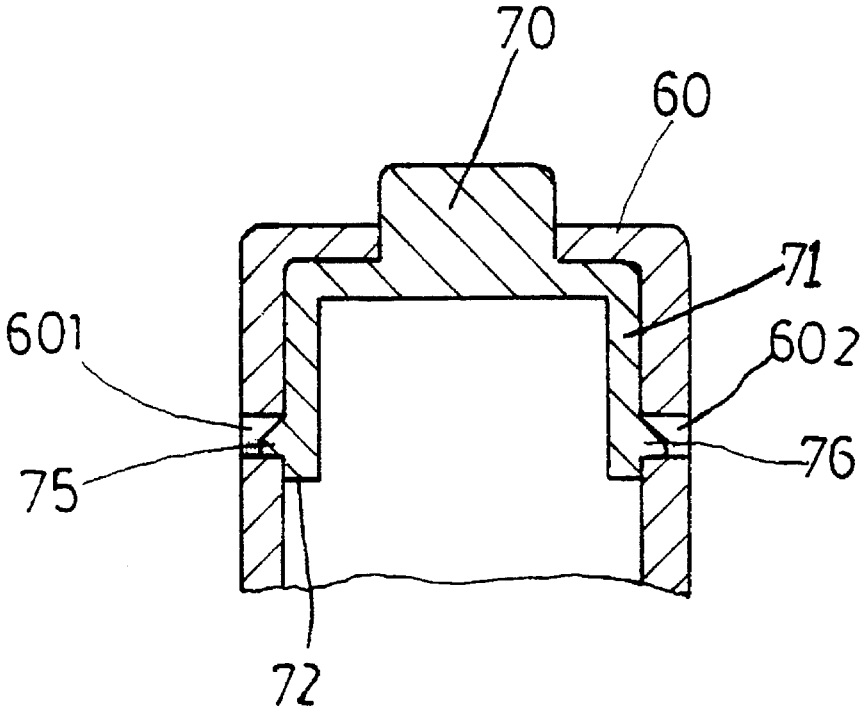
FIG. 4 is a cross section taken along line A—A of FIG. 3.

Referring to FIG. 4 and FIG. 3 again, a locking device 70 is mounted on the trigger 60 and controlled to stop the trigger 60 from turning about the pivot 61. The locking device 70 is a switching lever extended out of the curved front projection 62 of the trigger 60 and switched between the locking position and the unlocking position, having downward flanges 71 disposed inside the trigger 60, and raised portions 601 and 602 raised from the downward flanges 71 and moved in respective sliding ways 601 and 602 on the inside wall of the trigger 60. When the locking device 70 is switched to the unlocking position, the bottom is spaced above the elevation of the pivot 61.

Figure 5:
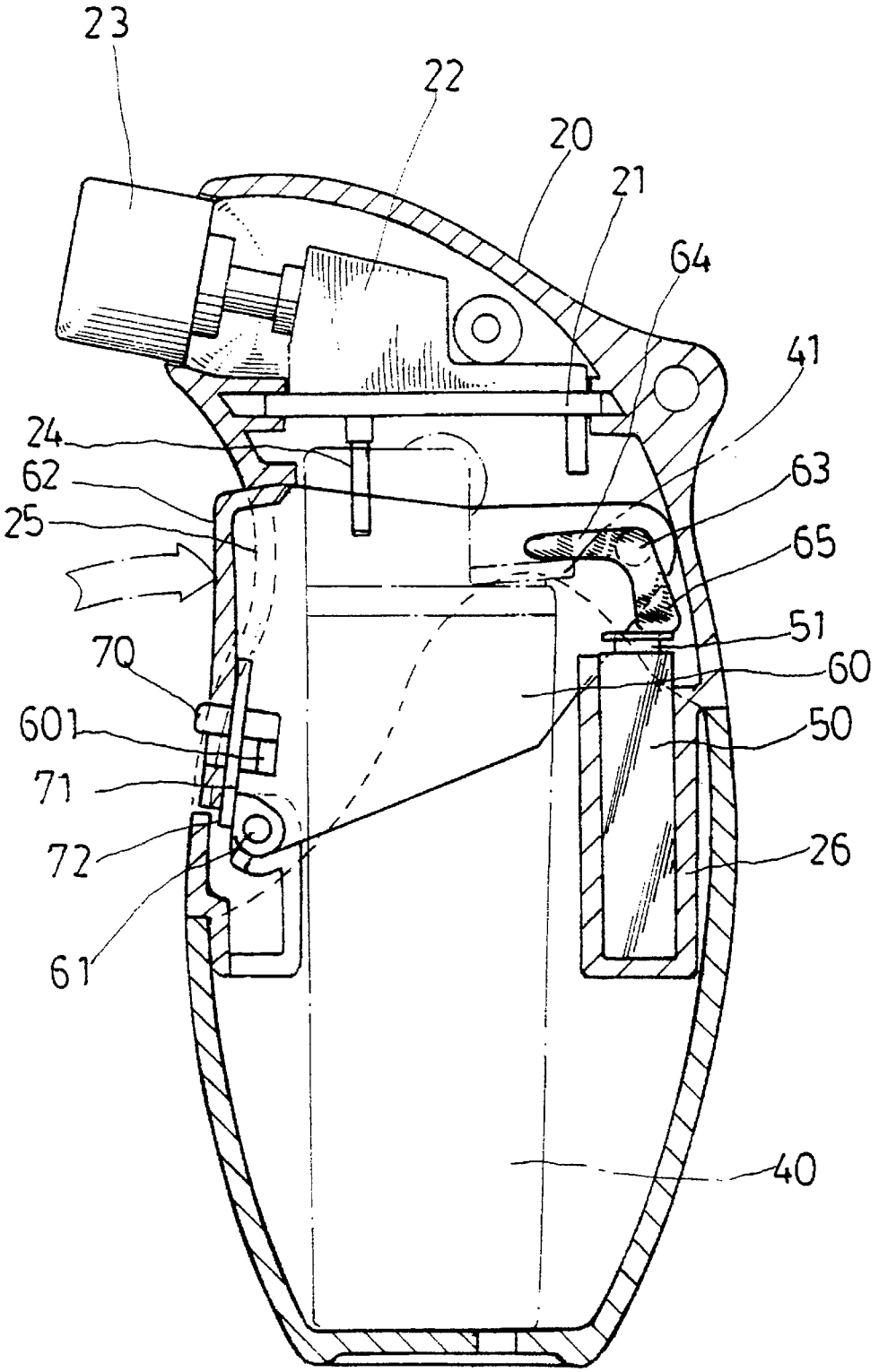
FIG. 5 is similar to FIG. 3 but showing the trigger triggered.

Referring to FIG. 5, when curved front projection 62 of the trigger 60 is depressed, the rear actuating plate 63 is moved downwards, causing the gas lever 41 and the control lever 51 depressed by the first and second rod sections 64 and 65 of the rear actuating plate 63, and therefore a flame is produced at the flame nozzle 23. When the trigger 60 is released, the gas lever 41 and the control lever 51 are released from the first and second rod sections 64 and 65 of the rear actuating plate 63, and therefore fuel gas is stopped.

Figure 6:
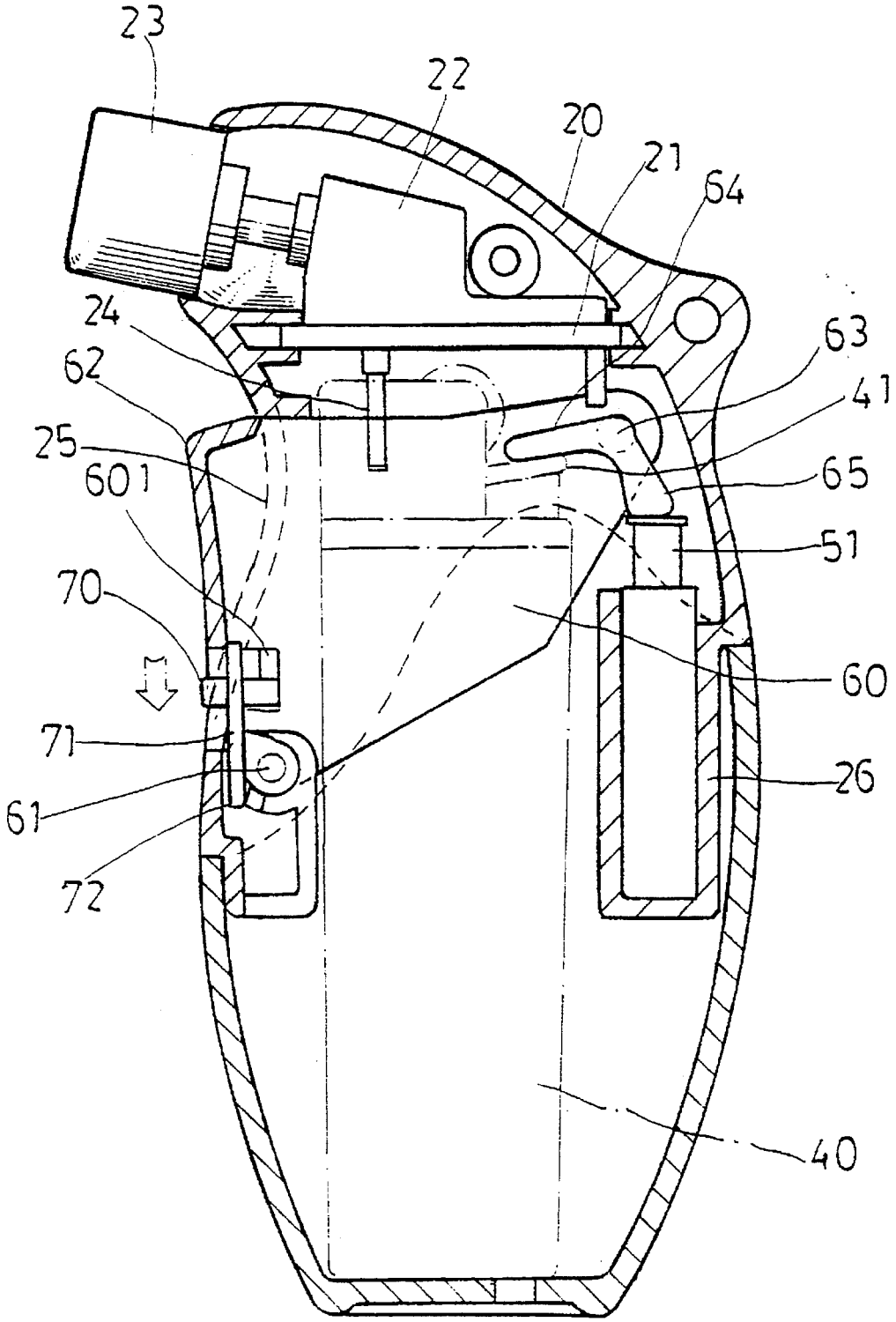
FIG. 6 is similar to FIG. 3 but showing the trigger locked.

Referring to FIG. 6, when the locking device 70 is switched downwards to the locking position, the bottoms 72 of the downward flanges 71 are moved downwards to an elevation below the pivot 61, and therefore the trigger 60 is stopped from turning about the pivot 61.

When in use, the container is held in the palm with the fingers smoothly laid on the trigger and the nearby area on the container. Therefore, the trigger can be conveniently depressed without effort.

What is claimed is:

1. A gas torch comprising:

a container which holds a disposable gas lighter, a casing detachably connected to said container to hold an electric ignition device, said casing having a horizontal partition wall to hold a gas flow guide and a flame nozzle, said gas flow guide having an inlet connected to a gas flow control valve of the disposable gas lighter, and an outlet connected to said flame nozzle, and a trigger that pivots about a pivot located inside said casing and has a smoothly curved front projection extended out of a front slot on said casing below said flame nozzle and a rear actuating bar terminating in two rod sections respectively stopped above a gas lever of the disposable gas lighter and the control lever of the electronic ignition device, said rod sections depressing the gas lever of the disposable gas lighter and the control lever of the electronic ignition device when said curved front projection of said trigger is depressed, thereby causing the disposable gas lighter to release a flow of fuel gas to said flame nozzle through said gas flow guide and simultaneously causing the electronic ignition device to produce sparks at said flame nozzle for burning said fuel gas;

said torch further comprising a locking device mounted within a hole on said trigger and moved between a locking position to prevent said trigger from being turned about said pivot and an unlocking position to allow said trigger be turned about said pivot, wherein said locking device comprises a switching lever protruding from the hole on said trigger and moving along a sliding track on said trigger, said locking device including flanges extended from said switching lever, said flanges include means to engage the sliding track, said locking device moving vertically relative to said pivot to move between said locking and unlocking positions.

2. The gas torch of claim 1 wherein said casing comprises a unitary inside chamber, which holds the electronic ignition device.

* * * * *